US007435195B1

(12) United States Patent
Calderon

(10) Patent No.: US 7,435,195 B1
(45) Date of Patent: Oct. 14, 2008

(54) STROKE TRAINING APPARATUS AND METHODS FOR USING SAME

(75) Inventor: Jose Luis Calderon, Queens, NY (US)

(73) Assignee: Tennis Muscle Memory International, Inc., New York, NY (US)

( * ) Notice: Subject to any disclaimer, the term of this patent is extended or adjusted under 35 U.S.C. 154(b) by 0 days.

(21) Appl. No.: 11/777,332

(22) Filed: Jul. 13, 2007

(51) Int. Cl.
*A63B 69/38* (2006.01)

(52) U.S. Cl. ..... 473/459

(58) Field of Classification Search ..... 473/459, 473/461; 446/236
See application file for complete search history.

(56) References Cited

U.S. PATENT DOCUMENTS

| | | | | |
|---|---|---|---|---|
| 3,693,973 | A | 9/1972 | Wattenburg | |
| 3,866,912 | A | 2/1975 | Scainetti | |
| 3,948,517 | A | 4/1976 | Feiler | |
| 4,089,521 | A | 5/1978 | Berst et al. | |
| D254,019 | S | 1/1980 | Fordon | |
| D265,413 | S | 7/1982 | Millikan | |
| 4,372,561 | A * | 2/1983 | Morgan et al. | 473/426 |
| 4,381,620 | A * | 5/1983 | Panzarella | 446/177 |
| D289,428 | S | 4/1987 | Sherman | |
| D297,659 | S | 9/1988 | Chinchiolo | |
| 5,360,363 | A * | 11/1994 | Levin | 446/46 |
| 5,409,217 | A | 4/1995 | Bobby | |
| 5,427,369 | A | 6/1995 | Baquet, Jr. | |
| 5,685,542 | A | 11/1997 | Weis | |
| D390,899 | S | 2/1998 | Mueller | |
| 5,873,798 | A * | 2/1999 | Bostick | 473/426 |
| 5,885,175 | A | 3/1999 | Marquez | |
| 5,957,781 | A * | 9/1999 | Kelly | 473/140 |
| 5,993,336 | A | 11/1999 | Repper et al. | |
| 6,645,094 | B2 | 11/2003 | Obidiegwu | |
| 7,041,016 | B1 * | 5/2006 | Omtvedt | 473/426 |
| 7,118,499 | B1 * | 10/2006 | Ling | 473/459 |
| 7,147,581 | B1 | 12/2006 | Williams, III | |
| 2001/0036874 | A1 | 11/2001 | Cathcart | |
| 2003/0017882 | A1 | 1/2003 | Hossack | |
| 2005/0014571 | A1 | 1/2005 | Varner | |
| 2005/0113193 | A1 * | 5/2005 | Wardle et al. | 473/459 |
| 2006/0009314 | A1 | 1/2006 | Bilsey | |
| 2007/0105664 | A1 | 5/2007 | Scheinert et al. | |
| 2007/0238556 | A1 * | 10/2007 | Gipple | 473/459 |

* cited by examiner

*Primary Examiner*—Raleigh W. Chiu
(74) *Attorney, Agent, or Firm*—Kalow & Springut, LLP; Scott D. Locke, Esq.

(57) ABSTRACT

An apparatus and method for the training of tennis strokes are provided that allow the user to develop spin and consistency in each stroke. The stroke training apparatus consists of a ball; a housing member comprising a first side, wherein the first side comprises a planar area and an opening that is circumscribed by the planar area; and an attachment means for attaching the ball to the housing member, wherein the ball can rotate around an axis and a non-zero volume less than or equal to one-half of the total volume of the ball protrudes through the opening on the first side. The method comprises contacting a racquet to the stroke training apparatus, guiding the racquet along the lower planar area, guiding the racquet along the surface of the ball after guiding the racquet along the lower planar area; and guiding the racquet along the upper planar area after guiding the racquet along the surface of the ball.

28 Claims, 6 Drawing Sheets

STROKE TRAINING APPARATUS AND METHODS FOR USING SAME

FIELD OF THE INVENTION

The present invention relates to the fields of sports.

BACKGROUND OF THE INVENTION

Many people participate in racquet sports such as tennis, squash, racquetball, etc. Regardless of whether those people are novices, recreational players, or professional athletes, for a large number of them there is a goal of improving their skills. Thus, there is a need to develop cost-effective and efficient means for helping them to improve their skills, including their racquet strokes.

One aspect of racquet sports for which skill improvement devices is lacking is the teaching of how to introduce spin to and to control the spin of a ball. These skills may be both subtle and difficult to learn.

Spin is important because it enables one to direct the location of the ball while increasing the difficulty that an opponent will have in returning it. In addition, a rapidly spinning ball is less likely to be affected by ambient playing conditions than a ball with little or no spin. It has been reported that certain tennis players can impart spin to their balls between 200 and 300 radians per second. (Human Kinetics, Inc. 2007)

Despite the importance of creating and controlling spin, many players mistakenly focus exclusively on hitting with more power to increase the effectiveness of their shots. As a result, they compromise control and precision. Moreover, an opponent with any moderate skill level will not have increased difficulty in returning a ball that has been hit with increased force, but without spin.

Based on the critical role and difficulty that creating and controlling spin has on an aspiring player's development, there is a need for new training tools to develop consistency in introducing spin to a tennis stroke. The present invention addresses this need.

SUMMARY OF THE INVENTION

The present invention provides apparatuses for improving one's stroke in racquet sports, as well as methods for using these apparatuses, and methods for teaching stroke improvement using them. Through the use of the present invention, an athlete can learn to introduce and/or to control better her racquet strokes in order to use spin effectively in her game. An "athlete" is any user of the present invention, regardless of age or skill level and the term is used interchangeably with the term "player."

According to a first embodiment, a stroke training apparatus is provided. The apparatus comprises a ball; a housing member comprising a first side, wherein the first side comprises a planar area and an opening that is circumscribed by the planar area; and an attachment means for attaching the ball to the housing member, wherein the ball can rotate around an axis and a non-zero volume less than or equal to one-half of the total volume of the ball protrudes through the opening on the first side. This apparatus is particularly advantageous when practicing the introduction of spin to forehand and backhand strokes.

According to a second embodiment, another stroke training apparatus is provided. This apparatus comprises a tennis ball, wherein the tennis ball has a total volume; a housing member comprising a first side, wherein the first side comprises a planar area and an opening that is circumscribed by the planar area; a rod, where the rod pierces the surface of the tennis ball at a first locus and at a second locus, wherein the first locus and second locus are 180 (one-hundred and eighty) degrees apart. The rod is attached to the housing member, and the tennis ball is capable of rotating around the rod, which travels along a diameter of the ball. A non-zero volume of less than or equal to one-half of the total volume of the tennis ball protrudes through the opening on the first side of the housing member.

According to a third embodiment, a method for improving a racquet stroke is provided. The method comprises contacting a racquet with a stroke training apparatus, wherein the stroke training apparatus comprises a ball, wherein the ball has a total volume; a housing member comprising a first side, wherein the first side comprises a lower planar area and an upper planar area; an opening, wherein the opening is circumscribed by the planar areas; and an attachment means, wherein the ball is able to rotate about a horizontal axis, a non-zero volume less than or equal to one-half of the total volume of the ball protrudes through the opening on the first side, and the housing member forms an angle of between 45 and 80 degrees with a horizontal plane. The method includes guiding the racquet along the lower planar area, guiding the racquet along the surface of the ball after guiding the racquet along the lower planar area, and guiding the racquet along the upper planar area after guiding the racquet along the surface of the ball.

There are many reasons why a player wants to add more spin to a ball. The more spin that a tennis ball has as it travels to the other side of the court, the better it is for the player that produces that spin. By way of example, the greater the control over the spin that a player has after the ball leaves her racquet, the harder she can hit the ball while still having her shot land within the court. Another reason has to do with offense. A ball that travels with a lot of spin becomes very difficult to return. The spin tends to give the ball an irregular bounce as it leaves the ground. Thus, in returning any kind of shot, it is desirable to be able to introduce more or different spin when the ball is destined to bounce deep in the court. Moreover, players who can introduce varying amounts of spin are particularly advantaged because their shots become even more difficult to predict.

Through the use of the apparatuses and methods of the present invention an athlete can learn to introduce spin to and control the spin of a ball by swinging at the ball with the racquet at a desirable angle. With this skill in hand, an athlete can have better control of her shots, and cause her opponent to have increased difficulty in returning them.

Figure 1:
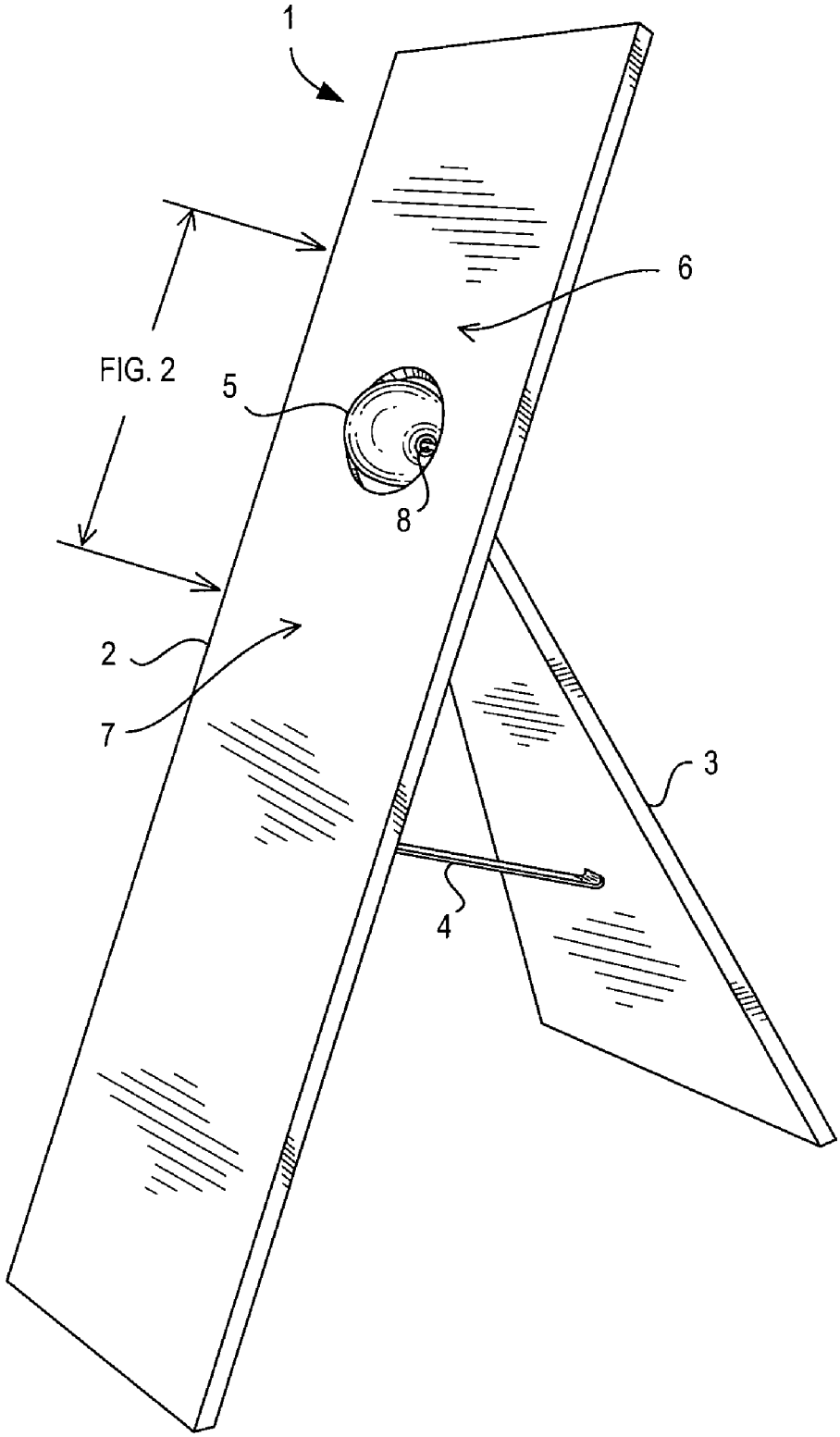
FIG. 1 is a representation of an apparatus of an embodiment of the present invention.

For illustrative purposes only and to enable a better view of the invention, the elements and components of the invention are not necessarily to scale relative to each other.

DETAILED DESCRIPTION OF THE INVENTION

According to a first embodiment, the present invention is directed to a stroke training apparatus. The stroke training apparatus comprises a ball, a housing member, and an attachment means.

The ball is a three dimensional object that has a total volume. The term "ball" includes but is not limited to spheres, such as tennis balls, squash balls, racquetball balls, baseballs, ping-pong balls, whiffle balls, and rubber balls. Other balls that may be used in some embodiments need not be symmetrical along every axis. Thus, balls that are elongated, such as footballs and rugby balls could be used if desired. Moreover, a ball may or may not be hollow. Preferably the ball is symmetrical along one axis and more preferably it is symmetrical along two axes. In some embodiments the ball is symmetrical around more than two axes, e.g. at least three axes; at least four axes; at least five axes; at least six axes, etc. Instead of using balls, one could use wheels or cylinders. Regardless of the shape of the ball, wheel or cylinder, preferably the component has a circular cross section.

The balls, wheels or cylinders could also contain materials on their insides that can produce noise when the ball spins, e.g., gravel, sand or bells. As a ball moves faster different noises could thus be generated.

The housing member supports the ball and contains an area (referred to as an "opening") through which the ball may protrude. In some embodiments, the shape of the opening is circular. However, the shape of the opening may be in the shape of an ellipse, oval, triangle, square, rectangle, rhombus, pentagon, hexagon, heptagon, octagon, nonagon, decagon, etc. or any other regular or irregular shape.

The size of the opening should be larger than the cross-section of the ball where the ball crosses the plane of the opening. In some embodiments there is between 1/16 (one-sixteenth) of an inch and 15/16 (fifteen-sixteenths) of an inch between the outside of the ball and the perimeter of the opening. In some embodiments there is between 1/8 (one-eighth) of an inch and 7/8 (seven-eighths) of an inch between the outside of the ball and the perimeter of the opening. In some embodiments there is between 1/4 (one-quarter) of and inch and 3/4 (three-quarters) of and inch between the outside of the ball and the perimeter of the opening.

As noted above different size balls can be used. When a tennis ball is used, for example, the diameter of the ball is approximately 2½" (two and one-half inches) and 2⅝" (two and five-eighths inches) (6.35 and 6.67 cm). If the opening is round, it may for example have a diameter of 2.75-3.25 inches when a tennis ball is used. When larger or smaller balls are used, the size of the opening should similarly be increased or decreased. For example, a squash ball has a diameter of 40.0+ or −0.5 mm, in which case the opening may for example be between 41.375 mm and 44 mm.

As a person of ordinary skill would appreciate, when the ball is larger, the width of the housing member may need to be larger as well. However, the width of the housing member may also be dictated in part by the length of the racquet head, such that the housing member is at least half as wide as the length of the face of the racquet. In some embodiments the width of the housing member is at least as much as two-thirds the length of the face of the racquet. In some embodiments the width of the housing member is at least as much as eighty percent of the length of the face of the racquet. In some embodiments the width of the housing member is at least as much as ninety-five percent the length of the face of the racquet. In some embodiments the width of the housing member is larger than the length of the face of the racket. By way of example, the housing member may be between 5 and 14 inches wide and between one-quarter of an inch and two inches thick. In some embodiments, the housing member may be between 7 and 12 inches wide and between three-quarters of an inch and one and one-half inches thick.

The housing member may, for example, be made of a wide variety of sufficiently strong, rigid materials such as, wood, plastic, steel, aluminum, graphite, Kevlar (made by du Pont) or fiberglass. In some embodiments, the housing member is lightweight and portable. The housing member may, for example, be between three feet and seven feet long. In some embodiments, it is between four feet and six feet long. For smaller players, it may be desirable to design the apparatus with a relatively smaller housing member, i.e., between three and four feet long.

When designing a housing member, at least one side should comprise a flat area, which may be referred to as a planar area. The planar area circumscribes the opening such that the part of the housing member leading up to and away from the opening on at least one side of the housing member is flat. This side may be referred to as a "first side" or "first surface" of the housing member and the opening on the first side may be referred to as a "first opening." In some embodiments, the planar area extends at least six inches on at least two sides of the first surface of the opening that are opposite of each other. In some embodiments, the planar area, which extends on both sides of the opening on the first surface, preferably is at least as wide as the width of the face of the racquet that will be used with the apparatus.

The parts of the planar area that are on two opposite sides of the opening (but both on the aforementioned first surface or first side) may be described as a lower area and an upper area. The lower area may be located between the opening and a first end of said first side of the housing member. The upper area may be located between the opening and a second end of said first side of the housing member. The opening is thus located between the lower area and the upper area. The opening may be viewed as having a center, and in some embodiments, the distance between said center and said first end is more than twice the distance between said center and said second end. In some embodiments, when in use, the lower area is closer to the floor and the upper area is distal to the floor. Because the opening is circumscribed by a planar surface, as one moves from the lower area, up the board to the upper area, when one reaches the opening, the planar surface may continue along what would be viewed as to the right and the left of the opening until the top of the opening is reached and one hits the upper area. Thus, the lower and upper area would meet along what may be viewed as the left and right side of the opening, and form one continuous planar (or flat) surface.

In some embodiments, the planar area extends at least twelve inches on at least one side of the opening, e.g., the lower area, and at least six inches on the other side of the opening, e.g., the upper area. In some embodiments, the planar area extends at least eighteen inches on at least one side of the opening and at least nine inches on the other side of the opening, e.g., the upper area. In some embodiments, the planar area extends at least twenty-four inches on at least one side, of the opening, e.g., the lower area, and at least twelve inches on the other side of the opening, e.g., the upper area. In some embodiments, the planar area extends at least thirty-six inches on at least one side of the opening, e.g., the lower area, and at least eighteen inches on the other side of the opening, e.g., the upper area.

In some embodiments, at least 50% of the first side (exclusive of the opening) is flat. In some embodiments at least 75% of the first side (exclusive of the opening) is flat. In some embodiments at least 90% of the first side (exclusive of the opening) is flat. In some embodiments, the entire first side (exclusive of the opening) is flat.

The housing member may also contain a second opening on a second side through which the ball protrudes. For example, the first and second openings may each be circular and form the ends of a cylindrical lumen that spans from the first side to the second side of the housing member. If the first side is thought of as the front of the housing member, the second side may be thought of as the back of the housing member. Accordingly, a portion of the volume of the ball may protrude through the opening on the second side when there is such an opening. If there is a second opening, the amount of the ball that protrudes through it may or may not be the same as the amount that protrudes through the first opening. If the board is sufficiently thick, no portion of the ball will protrude through the second opening, or there may be no second opening.

In one embodiment the housing member forms a three dimensional rectangle. In this embodiment, the width of the rectangular housing member may be larger than the diameter of the opening by at least two inches (e.g., larger than by one inch on each side, approximately five inches), but narrower than the length of a racquet face. The length of the racquet face refers to the distance of where the handle meets the face and the top of the racquet face. The length of this housing member may be 48 (forty-eight) inches and the thickness of the housing member may be 1 inch.

The apparatus also contains an attachment means. The attachment means attaches the ball indirectly to said housing member. The attachment means is configured to enable the ball to rotate around an axis. Additionally, the attachment means situates the ball such that a non-zero volume less than or equal to ½ (one-half) of the total volume of the ball protrudes through the opening on the first side. For example, ¼ (one-quarter) to 7/16 (seven-sixteenths) of the volume of the ball may protrude through the first side of the housing member. In some embodiments, ⅓ (one-third) to ⅜ (three-eighths) of the volume of the ball protrudes through the first opening. A volume of slightly greater than ½ (one-half) of the volume (i.e., up to 55%) could protrude so long as the additional volume does not impede the movement of the racquet as described below.

In some exemplary embodiments, the attachment means comprises a rod that travels through the center of said ball and is attached to the housing member.

In other exemplary embodiments, the attachment means comprises a first rod that pierces a first locus of the surface said ball, and a second rod that pierces a second locus of the surface of said ball, wherein said first locus and said second locus are located 180 degrees apart and each of said first rod and said second rod is attached to said housing member. Thus, in this embodiment no rod travels all of the way through the ball.

A rod may be a long cylinder that can form an axis around which the ball may spin. In some embodiments where a rod that spans the diameter of the ball is used the rod is shorter than the width of the housing member so that the rod can span the diameter of the ball and be partially lodged within the housing member on its ends, but not extend all of the way through the housing member. Exemplary rods may for example be cylindrical with a diameter between $1/16^{th}$ (one sixteenth) and $3/8^{th}$ (three eighths) of and inch. In some embodiments, the diameter is between $1/8^{th}$ (one eighth) and ¼ (one quarter) of an inch.

The ball may also contain reinforcers at the loci were the rod(s) pierce(s) the ball. The ball reinforcers may for example, be plastic pieces that are shaped like washers that are attached to the ball (e.g., by glue) and prevent the material of the ball from contacting the rod. Through the use of these elements one may reduce damage from friction between the rod and the ball. An exemplary ball reinforcer may be between ½ (one-half) and ⅗ (three-fifths) of an inch in its external diameter and between ¼ (one-quarter) and ⅜ (three-eighths) of an inch in its internal in diameter.

The stroke training apparatus may further comprise a stabilization member. The stabilization member enables the housing member to rest at least one predetermined angle relative to a horizontal plane. (I.e., the planar surface of the first side forms the angle with the horizontal plane.) The horizontal plane may e.g., be the floor, a table, a stool or any other surface on which the apparatus sits or with respect to which it is oriented. Thus, in addition to resting on the floor the apparatus may e.g., be attached to a wall, or suspended from a ceiling, so long as the desired angle is formed with a horizontal plane. In some embodiments, the housing member physically contacts the horizontal plane. In other embodiments the angle with the horizontal plane is measured by extending an imaginary line from the planar surface of the first side to the floor or other physical object.

The stabilization member may e.g., be designed to enable the housing member's planar area to form an angle of between 45 and 80 degrees with said horizontal plane. In some embodiments, the angle is between 55 and 75 degrees. In some embodiments, the angle is between 60 and 70 degrees. In some embodiments, the apparatus is designed such that when the planar surface of the apparatus forms the desired angle with the horizontal plane, the ball is oriented so that the axis around which it can rotate is parallel to the horizontal plane, when the planar surface is facing up at an angle.

The angle at which a racquet hits a ball will affect its spin. The greater the angle with the horizontal plane, the more spin that may be introduce to the ball when the player swings at the same speed.

The stroke training apparatus may be designed to be collapsible. For example, it may comprise a hinge that attaches a second side of said housing member and a first end of said stabilization member. The hinge would thus enable an athlete to rotate the stabilization member around the hinge until it forms a designed angle with the housing member. When opened it will enable the housing member to form the desired angle with the horizontal plane. When collapsed, the apparatus is convenient for travel.

The stroke training apparatus may further comprise a connecting member. The connecting member may be attached to the second side of the housing member and to a first side of said stabilization member (the side closest to the housing member). The connecting member may also be of a fixed length that prevents the stabilization member from forming too large an angle with the housing member. In some embodiments, when the connecting member is extended, the housing member and stabilization member form an angle that causes the housing member to form the desired angle with the horizontal plane.

In some exemplary embodiments, the connecting member contains a plurality of extension positions. For example it may contain at least two extension positions, wherein each of said at least two extension positions causes said housing member to form a different angle with said horizontal plane, and at least one angle is between 55 and 75 degrees. It may also contains at least three positions, at least four positions, at least five positions, at least six positions, etc. In some embodiments, all of these positions cause angles of the housing member and a horizontal plane (real or imaginary) to be between 45 and 80 degrees.

The connecting member is preferably a non-elastic material. For example, it may be made of cotton, wool, plastic or metal. If the connecting member is made of a soft material, and the apparatus is collapsible, when in operation the connecting member may be pulled straight. When extended, the connecting member may or may not run parallel to a horizontal plane depending on where its attachment points are on the housing member and stabilization member. In some embodiments the attachment points are the same distance from the bottom edges of the two members, thereby causing the housing member to run parallel to the floor when pulled taut. If the connecting member is not a soft material, it may for example contain two parts with a hinge that facilitates collapsing.

As noted above, the connecting member may also be configured to enable a plurality of angles between the housing member and the stabilization member to be formed. For example, the connecting member may comprise two slidable parts that can be held in a plurality of fixed positions through for example, one or more nuts and bolts.

By way of another example, the connecting member may be comprised of a flexible material with a clasp on the end of it. It may be attached to either the second side of the housing member or the first side of the stabilization member. If this connecting member is attached to the second side of the housing member then to the first side of the stabilization member there may be attached a receiving link or ring. Similarly, if this connecting member is attached to the first side of the housing member then to the second side of the stabilization member there may be attached a receiving link or ring. Through the use of multiple receiving rings (e.g., 2, 3, 4, 5, 6, 7, etc.) the stabilization member can be opened to multiple different angles.

To impart further stabilization, in some embodiments, there is a reinforcement member. The reinforcement member may be used to connect the second side of the stabilization member to the second side of the housing member at a point above the opening. In collapsible models, the distance between a point on the second side of the stabilization member and a second side of the housing member will be the greatest when the apparatus is collapsed (i.e., they are closest to each other). Thus, the reinforcement member is preferably not permanently attached to both members, or if parts of it are attached to both members, then they are not permanently attached to each other. Accordingly, the reinforcement member may for example be comprised of a flexible material with a clasp on one end attached to one member and the receiving link attached to the other member. These types of connections could also be made through for example magnets or other reversible latching systems.

The stroke training apparatus may also comprise an entry guide. The entry guide may form a concave trough with the right side (or left side) of the housing member. The concave trough is oriented to face away from the side on which it sits of the housing member. By facing away from a side, the concave trough opens toward the opposite side. Notably, the entry guide does not disrupt the planar area of the housing member. By way of example, the entry guide may be in the shape of a C, wherein one portion of the C contacts the second side (the back side) of the housing member, one portion contacts the right edge and extends to form the side of the trough, and one portion forms the top of the trough, thereby causing the bottom of the trough to be formed by a portion of the lower planar area.

In some embodiments the distance from the planar area to the upper edge of the trough (i.e., the height of the lumen) is 0.75 to 2.25 inches. In some embodiments it is between 1 inch and 1.75 inches. The preferable size may depend on the width of the rim of the frame of the racquet. Thus, when racquets with small frame widths are used the lumen should be commensurately smaller, i.e. 0.25 to 1 inch wider than the width of the rim of the frame. In some embodiments, the entry guide is approximately 6-16 inches long. In some embodiments it is approximately 6-14 inches long. In some embodiments it is approximately 10-12 inches long. In some embodiments, the distance between the edge of the trough and the side of the apparatus to which it is attached is between one and three inches.

Typical tennis racquets has faces that have between 90 square inches to about 110 square inches on a side. The rims of these racquets are typically between ¼ of an inch to about 1 inch wide.

In some embodiments, the top of the entry guide is preferably located 1-4 inches below the lowest point of the first opening.

In addition to or instead of an entry guide, there may be an exit guide. The exit guide is designed similarly to the entry guide. However, rather than being located near the lower area, it is located near the upper area of the housing member. When both the entry guide and exit guides are present, they will need to be on the same edge so that an athlete can maintain a continuous stroke. In these cases the exit and entry guides may form one long continuous guide.

In some embodiments, the bottom of the exit guide is preferably located 1-4 inches above the highest point of the first opening.

The entry, exit or continuous guides may be permanently affixed to the housing member or detachable. Permanently affixed guides may be attached by for example, glue or nails. Detachable guides may for example be attached by magnets or reversible screws.

The stroke training apparatus may further comprise a means for measuring the speed of rotation of the ball and/or its angular frequency. Because these parameters may be calculated from each other, they are collectively referred to as an angular frequency measurement. An angular frequency measurement device measures the number of rotations of the ball in a unit of time. The angular frequency measurement may produce a digital display of the number of rotations of the ball in a unit of time. One of the many means by which the angular frequency could be measured is to incorporate an isolated light reflecting spot on the surface of the ball along the axis perpendicular to the ball's axis of rotation. The angular frequency measurement device could count the number of electrical pulses created each time the isolated light reflecting spot passes over the sensor, which could be mounted at the opening of the housing member and in axial alignment with the isolated light reflecting spot on the ball surface. The output of the device would be in terms of rotations per unit time, and may be calculated after the cessation of rotation. Optionally, the device could also calculate the speed of rotation of the ball, measured in distance per unit time, by multiplying its original output by the radial length of the ball. It is understood that both of these measurements may be calculate as an average over the duration of ball rotation.

The device may also include sensors that detect when a racquet is in contact with the housing member and/or particular areas of the housing member. The sensors may for example display lights at the points of contact or elsewhere. This may be particularly helpful if an athlete tends to swing her racquet erratically and contacts only a portion of the racquet with the housing member.

The housing member may also be designed with a plurality of balls in a vertical line. For example, there may be two, three, four balls, etc. These balls may each be present in separate discrete openings, or they may be within one larger opening, e.g., a rectangle. When there is a plurality of balls in a vertical line, each ball has its own rod and can rotate freely. The rods are preferably parallel to each other.

In some embodiments, instead of a ball, one may use one or more horizontal rows of spinnable beads. One may also use horizontal rows of balls if the row is smaller than the cross-section of the face of the racquet that is destined to come into contact with them. The balls or beads appear in a horizontal line, they be in one or more than one separate openings.

In some embodiments, the rod(s) within the ball (or balls) may be able to be rotated within the plane of the housing member. For example, in the embodiments described above the rod is parallel with a horizontal plane (e.g., the floor). However, in some embodiments the rod may form an angle with a horizontal plane. (As used herein, the phrase "forming an angle with a horizontal plane" includes a rod that does not connect with a horizontal plane, but if it were extended to the floor would thereby form the angle.) In some embodiments, this angle is between 0 and 30 degrees. In some embodiments, this angle is between 5 and 25 degrees. In some embodiments, this angle is between 10 and 20 degrees.

The apparatus may be configured such that this angle is fixed or reversible. To form a fixed angle, the rod may be attached as describe above, with one end of the rod inserted through the housing member at a point closer to a first end of the housing member and the second end of the rod being located at a point closer to a second end of the housing member and at a point on the opening 180 degrees away from where the first rod meets the housing member.

To form an apparatus with reversible placements for the rod, one may e.g., design the rod to be longer than the width of the housing member. The ends of the rod may contain screw threads that can reversibly feed into wing nuts. The housing member may contain slits on either side in the area of the opening through which the rod may protrude. When the nuts are loosened, the rod may be rotated. The nuts may then be tightened to fix the rod in place.

In an alternative example, the inner lumen of the opening may contain a lightweight open (hollow) gear with the rod fixed along the diameter of the gear. The open gear may be interlocked with a compatible gear that is internal to the housing member and turned, using well known mechanisms like that of a dial on a rotary timer, a full 360 degrees so that the rod can be positioned at whatever angle the athlete requires.

In another alternative example, the inner lumen of the opening may contain small notches of flexible material, like rubber, spaced just far enough from each other to form a tight fit with the thickness of the rod. In this example, the rod may be removed and inserted in different notches around the circumference of the inner lumen. The rod may be further secured with locking caps over the open notches, if necessary.

In some embodiment the apparatus may further comprise an arc extension. When the apparatus is in use, the arc extension may appear as a continuation of the top of the housing member. Thus, the arc extension also has a first side that is flat. The arc is shaped as approximately $\frac{1}{8}^{th}$ to $\frac{3}{8}^{ths}$ of a circle, oval, ellipse or other regular or irregular curved object. The arc may also be shaped as one side of a parabola. The arc is oriented in a manner such that the inner (or concave) side of the arc points toward the ground.

In some embodiments, the arc may for example begin approximately 3-12 inches above the top of the opening. The arc may curve to the left or to the right. When a right-handed player practices a forehand swing (and a left-handed play practices a backhand swing, e.g., the one handed backhand), the arc should extend to the left. When a left-handed player practices a forehand swing (and a right-handed play practices a backhand swing, e.g., the one handed backhand), the arc should extend to the right.

In some embodiments the arc area may commence at the top of the opening. Particularly with smaller players it may be advantageous to start the arc closer to the opening. As noted above, the arc member's curvature provides a guide for a player's follow through. However, because it contains a flat first side that is consistent with the planar area of the housing member, the arc and the housing member may form one continuous flat surface. By forming one continuous flat surface, a user will be trained to keep the face of her racket in the same direction for a longer period of time.

The apparatus may also contain a marking on the first side (e.g., a horizontal line that extends part way or completely across the first side) on the first side approximately one to three inches below the lowest edge of the opening. This marking will demonstrate to a user the area where she should drop her wrist. As persons of ordinary skill in tennis know, when introducing spin to a ball one may swing the racquet with one's arm extended and let her wrist "drop" or form a smaller angle with a vertical plane (larger angle with a horizontal plane). For example, if one's arm forms a 40-50 degree angle with a horizontal plane, prior to contacting the ball, one's wrist should form a 60-70 degree angle with the horizontal plane. When using the apparatus the wrist should be dropped to this angle prior to reaching the aforementioned marking on the board.

According to another embodiment, the present invention is directed to a stroke training apparatus comprising: a tennis ball, wherein the tennis ball has a total volume; a housing member comprising a first side, wherein the first side comprises a planar area and an opening, wherein the opening is circumscribed by said planar area; a rod, wherein the rod pierces the surface of the tennis ball at a first locus and at a second locus, wherein the first locus and said second locus are 180 degrees apart, wherein said rod transverses the diameter of the ball and is attached to the housing member, the tennis ball is capable of rotating around the rod and a non-zero volume less than or equal to one-half of the total volume of the tennis ball protrudes through the opening on said first side of said housing member.

According to a third embodiment, the present invention is directed to a method for improving a racquet stroke, wherein said method comprises: (a) contacting a racquet with a stroke training apparatus, wherein said stroke training apparatus comprises (i) a ball, wherein said ball has a total volume, (ii) a housing member comprising a first side, wherein said first side comprises a planar area comprised of a lower area and an upper area, and an opening, wherein said opening is circumscribed by said planar area, and (iii) an attachment means, wherein said ball is able to rotate about a horizontal axis, a non-zero volume less than or equal to one-half of the total volume of said ball protrudes through said opening on said first side, and said housing member forms an angle of between 45 and 80 degrees with a horizontal plane; (b) guiding said racquet along said lower planar area; (c) guiding said racquet along a surface of said ball after guiding said racquet along said lower planar area; and (d) guiding said racquet along said upper planar area after guiding said racquet along said surface of said ball.

The term "guiding" means any speed with which a racquet contacts the planar surface or ball. When an athlete first uses the device, she may slowly guide the racquet along the lower area of the first side, the ball and the upper area. As she becomes more comfortable she may swing her racquet faster and with more force while maintaining the points of contact. The faster that she swings, the greater the spin that she will be able to introduce into the ball.

The racquet may comprise a solid face or a webbing as is common with tennis or squash racquets. In some embodiments the racquet is a tennis racquet, and the ball is a tennis ball. When the racquet is a tennis racquet, preferably the face has a surface of 84-120 square inches on each side. When teaching an athlete to use the present invention, it may be desirable to have her first run her hand long the lower area, along the ball and then over the upper area to explain the principles of spin.

When a racquet contains a face and a frame, as with a tennis or squash racquet, the frame is the part that will come into contact with the planar areas of the housing member. The frame may also incidentally contact the ball, but it is important for the face of the racquet to contact the ball as well.

A further understanding of the present invention may be had by reference to the accompanying figures.

FIG. 1 is a perspective view of the apparatus, 1. The apparatus comprises a housing member, 2, which has a flat side. The back support 3 forms the stabilization member. A connecting member 4 is comprised of a soft material that permits the housing member and the stabilization member to be separated a fixed amount, thereby forming a predetermined angle with the horizontal (and with each other). Within the housing member is a ball, 5. Less than ½ of the volume of the ball protrudes above the housing member. A lower area, 7, and an upper area 6 each comprise a flat surface. A rod 8 runs through the diameter of the ball and is seen only where it exits the ball.

Figure 2:
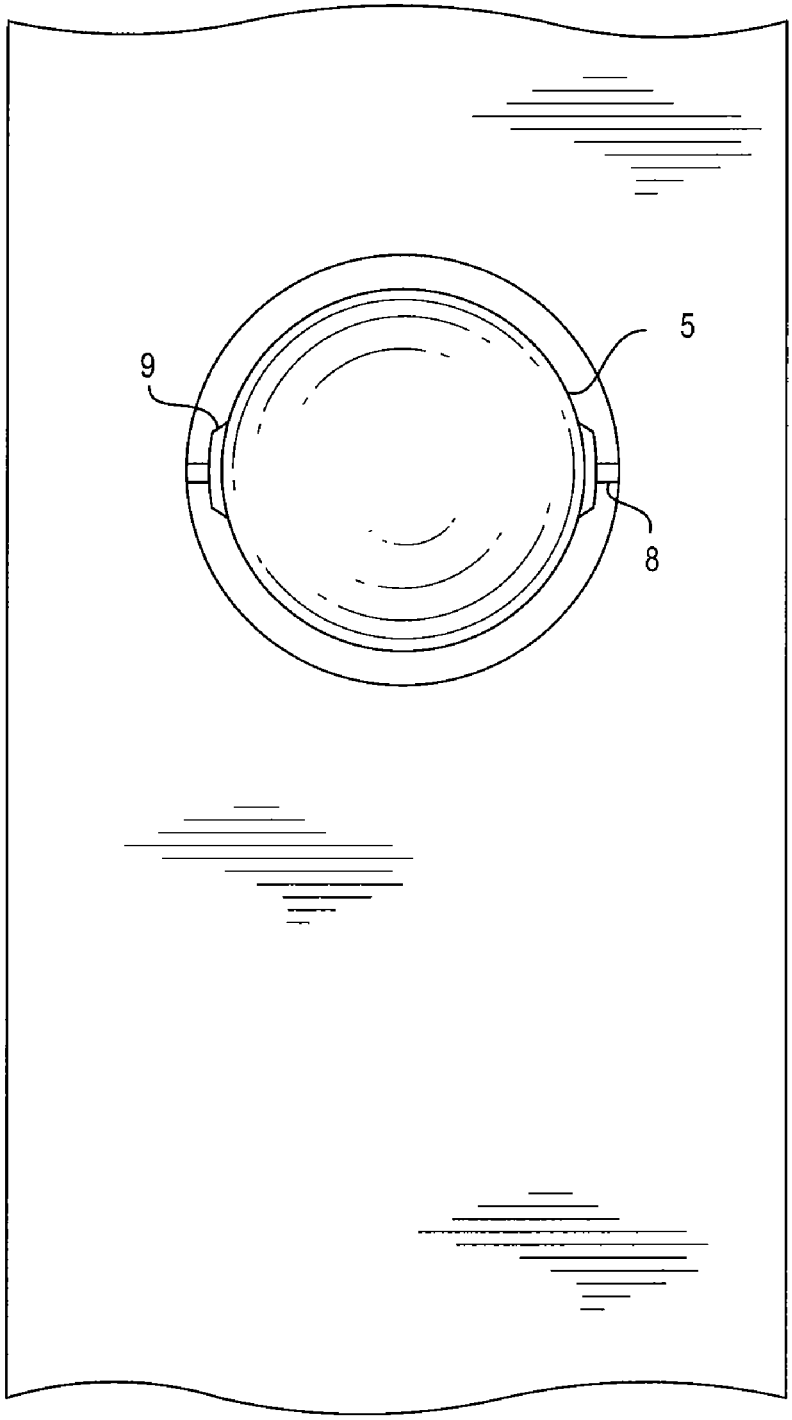
FIG. 2 is a representation of a magnified view of a ball in a housing member of an embodiment of the present invention.

FIG. 2 is a close up representation of FIG. 1. The ball 5 is located within an opening and is attached through a rod 8. At the location of the ball where the rod enters and exits are plastic reinforcement washers 9 to prevent friction between the rod and the ball to cause the ball to deteriorate.

Figure 3:
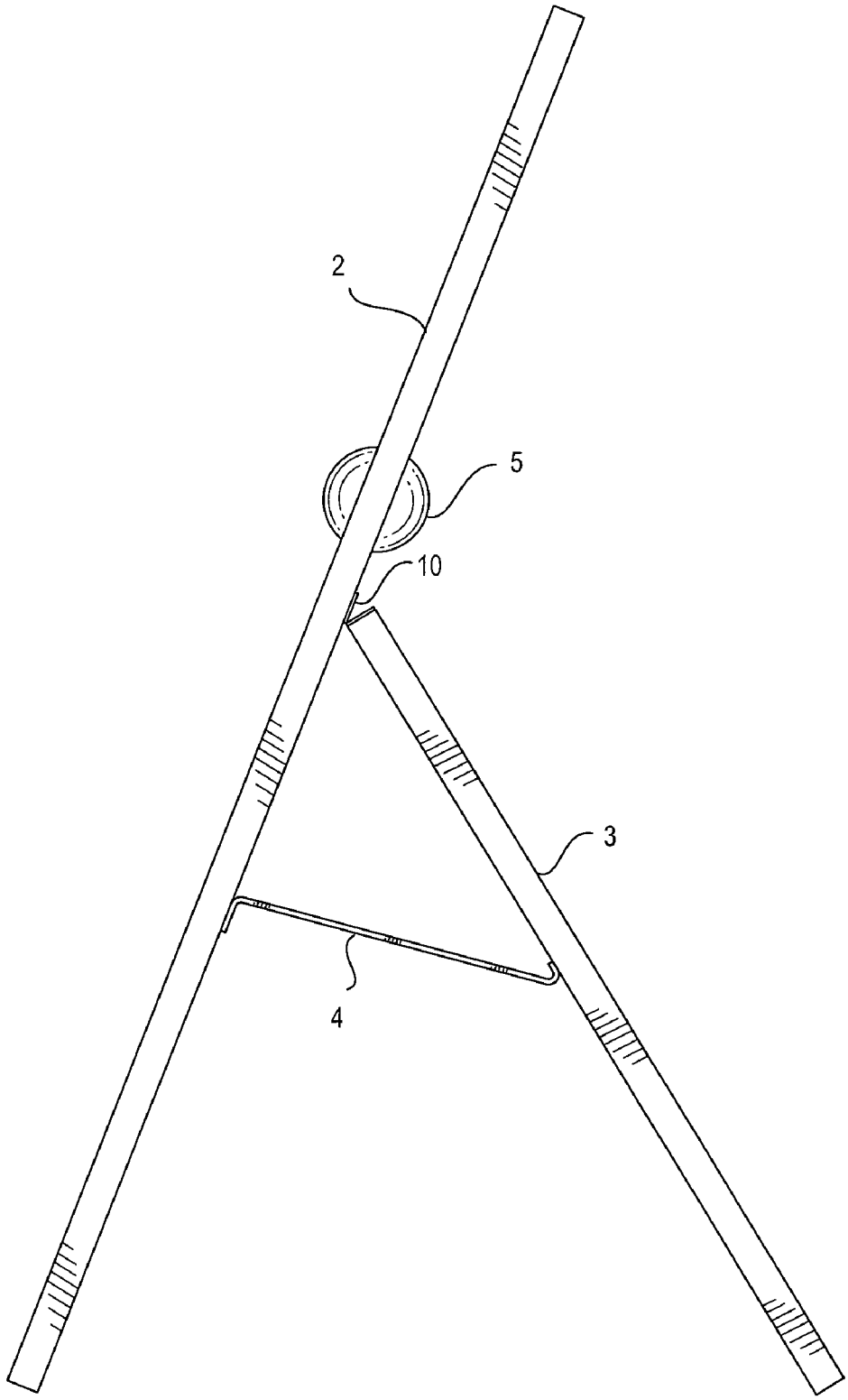
FIG. 3 is a representation of an embodiment of the present invention from the side.

FIG. 3 is a view of an embodiment of the apparatus from the side. The ball 5, is seen protruding through the housing member 2, which the connecting member 4, links to the stabilization member, 3. Additionally, a hinge 10 at the top of the stabilization member connects it to the housing member. Thus, the stabilization member can rotate around the hinge only the extent that the connecting member prevents rotation beyond a predetermined angle.

Figure 4A:
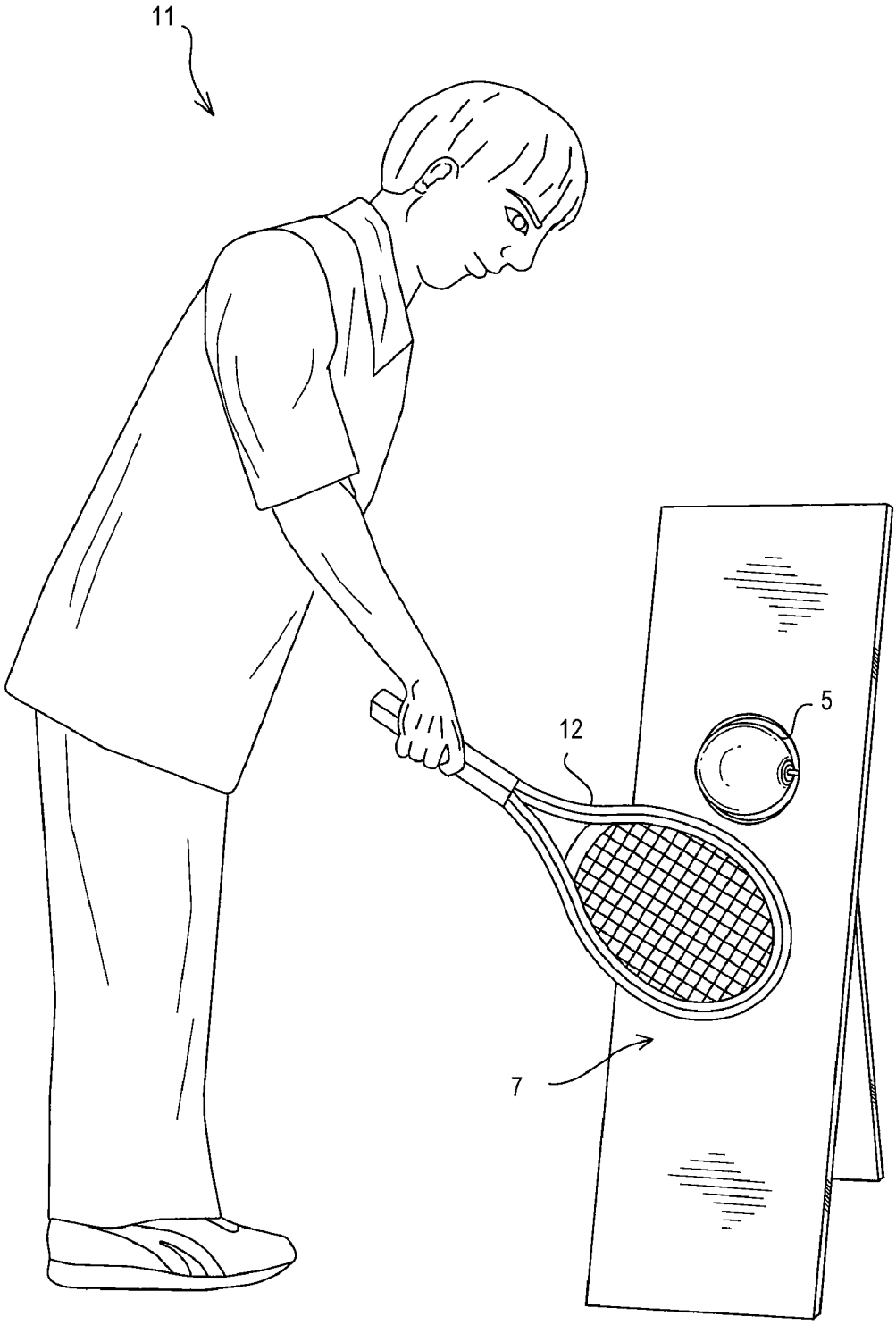
FIGS. 4A, 4B and 4C are representations of a person using an embodiment apparatus of the present invention.

FIG. 4A is a representation of a person 11 using the device. He guides a tennis racquet 12 up the first side of the housing member by contacting the lower area 7, below the ball 5. Here the rim of the racquet moves along the lower area.

Figure 4B:
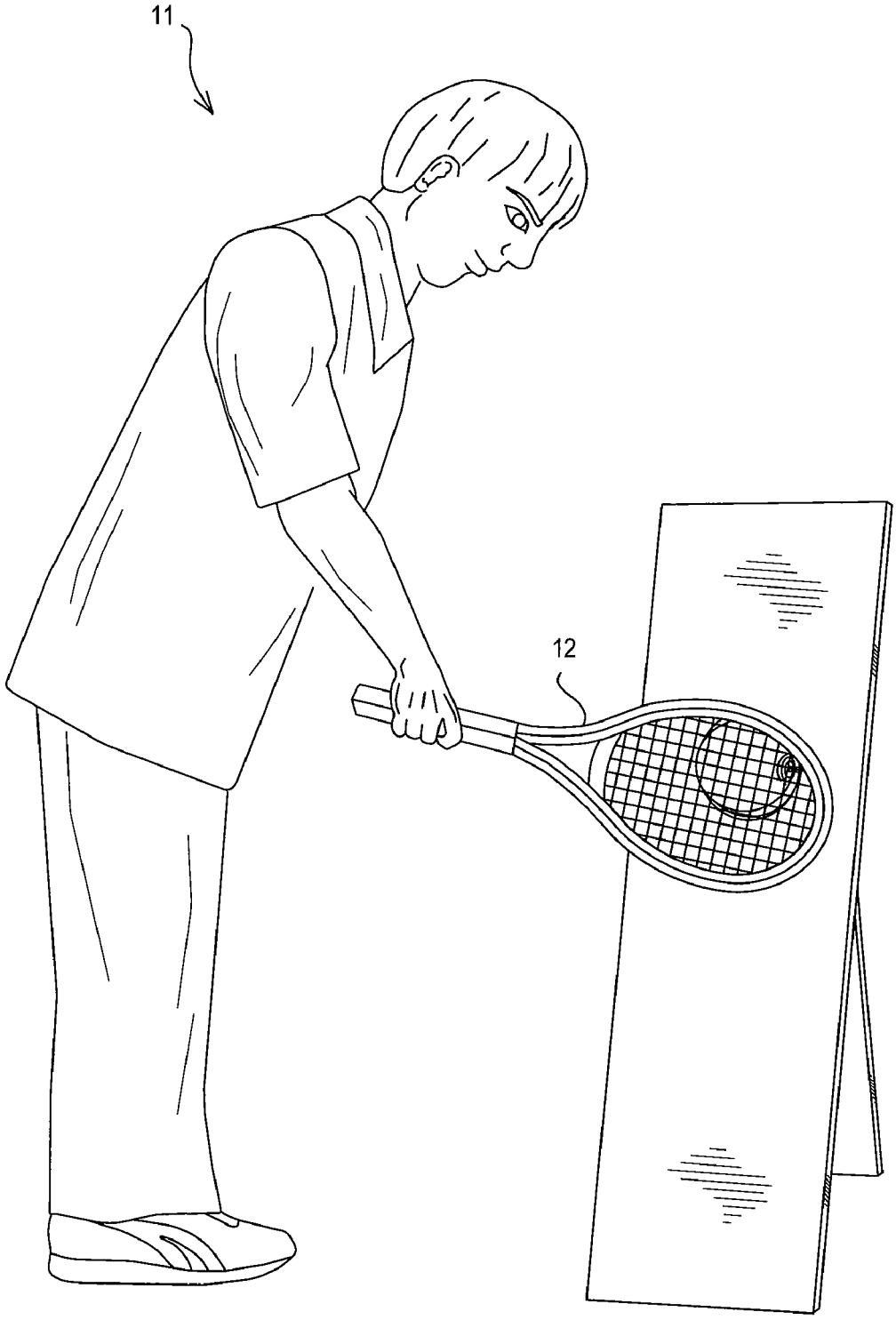

FIG. 4B is also representation of a person 11 using the device. In this figure, after guiding the racquet 12 along the lower area as in 4A, he guides it over the ball. The ball, being connected to the housing member through the rod can spin within its three dimensional space. The face or strings of the racquet move over the ball, causing it to spin.

Figure 4C:
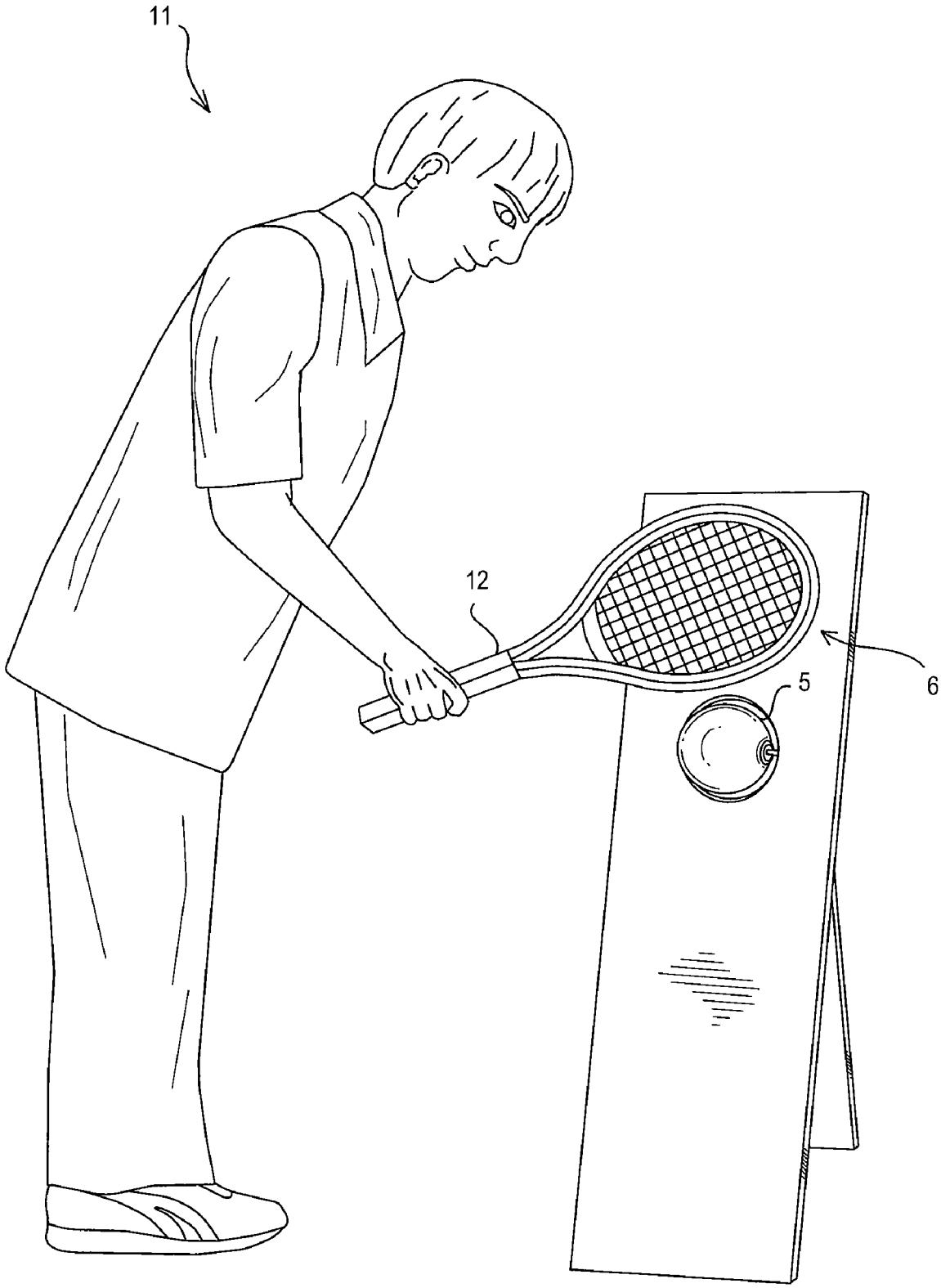

FIG. 4C is a also representation of a person 11 using the device. After having guided the racquet over the ball 5 in FIG. 4B he continues his swing of the racquet 12 up the board over the upper area 6, where the rim of the racquet is in contact with the upper area.

Different users may stand different distances from the device. The distance will in part be determined by the size of the user and the length of the racquet. For example, a child who is approximately 40 inches tall (the average height for four year old boys and girls), should stand about 10 inches to the side and about 4 inches back of the apparatus when practicing his or her forehand stroke. An adult, who is approximately 72 inches tall (6' feet) should stand approximately 18 inches to the side and 7.2 inches back when practicing a forehand stroke. The ball should be at a height of approximately 1-6 inches below the waist of the player, which is a preferable height for one to make contact with the ball.

To practice the forehand stroke the player should bring the racquet head back about shoulder high, then swing the racquet towards the ball in an angular manner dropping her wrist down to reach a point on the first side of the housing member that is about 1 inch below the ball. The reach point is measured by the distance between the lowest portion of the ball and the closest part of the racquet to the ball when the racquet contacts the housing member.

The player then continues her swing by guiding the racquet over the ball and up the first side of the housing member. As the racquet leaves the ball and continues to travel over the board the racquet should stay touching the board the entire length of the board and then follow around the shoulders to complete the follow through. As noted above, the frame of the racquet should touch the housing member, but the face of the racquet should come into contact with the ball.

The apparatus and methods of the present invention may be used by athletes including novices, recreational players and professionals in their own homes or on a tennis, squash or racquetball court. Further, athletes may use them with or without the assistance of an athletic instructor. Moreover, these devices may be combined with physical training exercises at exercise facilities.

Accordingly, the present invention is also directed to athletic facilities that comprise the apparatuses of the present invention. At the facilities, the apparatuses may exist as collapsible devices or be moveable but non-collapsible devices or be fixtures, (e.g. mounted to a wall). When mounting to a wall, the mounting apparatus may be such that the apparatuses of the presenting invention can be mounted at different heights, and locked in at those different heights. The wall-mounting device may also contain a rotation mechanism that would permit the player to change the angle of the apparatus and the direction.

For example, if the housing member is stored attached to the wall it may be contained in a track with a key locking mechanism similar to one used by gyms for exercise equipment that permits it to be raised or lowered for users of different heights, i.e., through the insertion of pins into pin receiving holes. The apparatus may be stored vertically or on an angle relative to the horizontal plane.

There may also be a rotation mechanism that permits a player to rotate the device clockwise and/or counterclockwise and then to lock it in at a desired angle. By permitting the device to be rotated clockwise or counterclockwise, both left-handed and right-handed players can use the device for both their forehands and their backhands. If the device is configured to be used by both right and left handed players, preferably the upper area and lower areas are the same size.

Mechanisms for reversibly setting an apparatus at an angle are well known to persons of ordinary skill in the art. For example, a housing member may be connected to a wall along a vertical track through the extension of a pole. As noted above, the pole may move up and down the track and be locked in at various heights through for example a pin that may be inserted into a hole to prevent gravity from causing the device to be lowered further.

The housing member may also have a retractable retaining pin at one end that is housed in or attached to the housing member and that may extend toward the wall. The wall may comprise a plurality of retaining sockets at different locations. The retaining pin may be retracted to enable rotation around the axis of the pole. As the housing member is rotated the retaining pin may come into alignment with different retaining sockets. When the housing member is at a desired angle, the retaining pin may be released to lock into one of the holes or sockets. In some embodiments the apparatus contains a plurality of retracing pins, e.g., at least two, at least three, at least four, etc. When a plurality of pins are present, in some embodiments preferably one of them is located in the proximity of the upper area and the other is located in the proximity of the lower area.

The present invention is also directed to methods for teaching the improvement of racquet strokes. An instructor may show and/or tell an athlete to guide her hand or racquet along the first side of the housing member starting at the lower area, then along the ball, then along the upper area. The instruction may be live, or on a DVD or over the Internet.

An exemplary apparatus may be made by cutting a piece of wood four feet long by six inches wide by half an inch thick. One may make a hole such that its center is about nine to twelve inches from the top, and one and one-half inches from the sides. The hole may be approximately three inches in diameter. This will enable a tennis ball to fit in it.

One may then drill one hole on each side of the board twelve inches from the top. One will also drill two holes in the tennis ball, 180 degrees apart. The rod should first be thread through one hole in the board, then the ball, then the other side of the board. The two holes in the board may be sealed with a staple gun. The diameter of the rod is preferably 1-3 mm smaller than the holes in the ball, which will enable the ball to rotate freely around the rod.

To construct the stabilization member, one may start with a piece of wood that is three feet high by twelve inches wide by one half an inch thick. To increase stabilization, one may want to make the top portion of the stabilization member narrower than the bottom portion. Accordingly, one may cut out or shave away two pieces that each correspond to 18 square inches from the corners on the top portion (two sections 3 inches by 6 inches), thereby leaving a six inch wide stem protruding vertically from the remainder of the board. From the base of this six-inch protrusion, one may further cut the board at angle to the remaining base corners. This will increase stabilization. Stabilization can be further increased by using a relatively heavy material. However, when the device is portable, the goal of stabilization should be balanced against the desire to make it light weight for easy transport.

One will attach a hinge to one end of the stabilization member and to the housing member below the opening on the second side. A connecting member that may for example be leather or cloth of ten inches long and one inch wide may be affixed to the housing member on the second side. It will be affixed (e.g. by stapling) on the second side of the housing member between the hinge and first side of the housing member so that the hinge is between the opening and the connecting member. The connecting member is also attached to the stabilization member. Because the connecting member is non-elastic, when the housing member and stabilization member are extended maximally around the hinge they form a fixed angle. By the principle of geometry, this forces the housing member to form a fixed angle with a horizontal plane.

The apparatus and method of the present invention may be modified to facilitate the introduction of spin to strokes for serves and underhanded slices. For example, the housing member of the upper and lower areas of the first embodiment may each be separate components that come together to form a "V" shape at approximately where the attachment means is located. (The arms of the V may, but need not be the same length.)

For this slice stroke training apparatus, the first arm may be akin to and the same size as the lower area of the first embodiment, and also comprise the attachment means and ball in the proximity of the meeting point of the two arms. For example, the attachment means may be located approximately 1-2 inches in from the meeting point of the two arms of the V (also referred to as the vertex). The second arm of the "V" contains (and may be the same size as) what was the upper area of the first embodiment. What was the first side of the first embodiment appears as the outside of the "V." Thus, these two arms of the V contain planar surfaces on the sides that are the closest to the floor. The ball is exposed through the first side of the first arm of the V. However, because of the location of the ball and its size, a portion of the ball will also be exposed through the second arm of the V. A portion of what was the opening in the first embodiment appear in each arc at the vertex, with approximately 60%-85% of the opening now being in the first arm.

The V is preferably wide and in some embodiments between the two arms there is an angle of between 140 and 170 degrees. In some embodiments there is an angle of between 150 and 160 degrees. A user may use this slice stroke training apparatus by swinging her racket along the underside of one side of the V, over the ball and up the other underside of the V.

The "V" shape may be fixed or releasable. For example, the upper and lower areas may be attached via one or more hinges, e.g., two hinges that are located on second side of the opening of the housing member. The hinges may be designed to enable the V to open to any angle. In some embodiments the amount that they may open is restricted to forming the desired angles noted above. The restriction mechanisms may for example be similar technologies to those used to maintain the housing member and stabilization member at fixed angles.

The device may also advantageously be used when training to introduce spin to one's serve. However, because it is desirable to hit a ball that is being served just prior to the ball's reaching its highest point, one should practice their stroke along a vertical board that is located above one's head. Thus, the housing member, ball and attachment means should be of the same dimensions as the first embodiment, but located either along a wall or a suspended in air.

While the present invention has been described with reference to one or more preferred embodiments, such embodiments are merely exemplary and are not intended to be limiting or represent an exhaustive enumeration of all aspects of the invention. Further, it will be apparent to those skilled in the art that numerous changes may be made in such details without departing from the spirit and the principles of the invention.

Unless otherwise specified, any of the features of any of the embodiments may be used in connection with any of the other embodiments.

I claim:

1. A stroke training apparatus comprising:

a. a ball, wherein said ball has a total volume, and said ball is a tennis ball;

b. a housing member comprising a first side, wherein said first side comprises a planar area and an opening, wherein said opening is circumscribed by said planar area; and c. an attachment means for attaching said ball to said housing member, wherein said ball can rotate around an axis and a non-zero volume less than or equal to one-half of the total volume of said ball protrudes through said opening on said first side.

2. The stroke training apparatus of claim 1, wherein said planar area comprises a lower area and an upper area, wherein said lower area is located proximal to a first end of said first side of said housing member and wherein said upper area is located proximal to a second end of said first side, and said opening is located between said lower area and said upper area, wherein said opening has a center, and the distance between said center and said first end is more than twice the distance between said center and said second end.

3. The stroke training apparatus of claim 2 further comprising an entry guide, wherein said entry guide forms a concave trough with said first side of said housing member and the concave trough faces away from said first edge of said housing member.

4. The stroke training apparatus of claim 1, wherein said opening is a circle.

5. The stroke training apparatus of claim 1, wherein said attachment means comprises a rod that travels through the center of said ball and is attached to said housing member.

6. The stroke training apparatus of claim 1, wherein said attachment means comprises a first rod that pierces a first locus of said ball, and a second rod that pierces a second locus of said ball, wherein said first locus and said second locus are located 180 degrees apart and each of said first rod and said second rod is attached to said housing member.

7. The stroke training apparatus of claim 1 further comprising a stabilization member, wherein said stabilization member is capable of orienting said housing member at least one predetermined angle relative to a horizontal plane.

8. The stroke training apparatus of claim 7, wherein said housing member forms an angle of between 45 and 80 degrees with said horizontal plane.

9. The stroke training apparatus of claim 8 further comprising a hinge, wherein said hinge attaches a second side of said housing member and a first end of said stabilization member.

10. The stroke training apparatus of claim 9 further comprising a connecting member, wherein said connecting member is attached to said second side of said housing member and to a first side of said stabilization member.

11. The stroke training apparatus of claim 10, wherein said connecting member is a non-elastic material.

12. The stroke training apparatus of claim 10, wherein said connecting member contains at least two extension positions, wherein each of said at least two extension positions causes said housing member to form a different angle with said horizontal plane, and at least one angle is between 45 and 80 degrees.

13. The stroke training apparatus of claim 1, further comprising an angular frequency measurement device, wherein said angular frequency measurement device measures the number of rotations of the ball in a unit of time.

14. The stroke training apparatus of claim 13, wherein the angular frequency measurement device produces a digital display of the number of rotations of the ball in a unit of time.

15. A stroke training apparatus comprising:

a. a tennis ball, wherein said tennis ball has a total volume;

b. a housing member comprising a first side, wherein said first side comprises a planar area and an opening, wherein said opening is circumscribed by said planar area;

c. a rod, wherein said rod pierces the perimeter of said tennis ball at a first locus and at a second locus, wherein said first locus and said second locus are 180 degrees apart, wherein said rod is attached to said housing member, said tennis ball is capable of rotating around the rod and a non-zero volume less than or equal to one-half of the total volume of said tennis ball protrudes through said opening on said first side of said housing member.

16. A stroke training apparatus comprising:

a. a ball, wherein said ball has a total volume;

b. a housing member comprising a first side, wherein said first side comprises a planar area and an opening, wherein said opening is circumscribed by said planar area; and c. an attachment means for attaching said ball to said housing member, wherein said ball can rotate around an axis and a non-zero volume less than or equal to one-half of the total volume of said ball protrudes through said opening on said first side, wherein said planar area comprises a lower area and an upper area, wherein said lower area is located proximal to a first end of said first side of said housing member and wherein said upper area is located proximal to a second end of said first side, and said opening is located between said lower area and said upper area, wherein said opening has a center, and the distance between said center and said first end is more than twice the distance between said center and said second end.

17. The stroke training apparatus of claim 16, wherein said ball is a sphere.

18. The stroke training apparatus of claim 16, wherein said attachment means comprises a rod that travels through the center of said ball and is attached to said housing member.

19. The stroke training apparatus of claim 16, wherein said attachment means comprises a first rod that pierces a first locus of said ball, and a second rod that pierces a second locus of said ball, wherein said first locus and said second locus are located 180 degrees apart and each of said first rod and said second rod is attached to said housing member.

20. The stroke training apparatus of claim 16 further comprising a stabilization member, wherein said stabilization member is capable of orienting said housing member at least one predetermined angle relative to a horizontal plane.

21. The stroke training apparatus of claim 20, wherein said housing member forms an angle of between 45 and 80 degrees with said horizontal plane.

22. The stroke training apparatus of claim 21 further comprising a hinge, wherein said hinge attaches a second side of said housing member and a first end of said stabilization member.

23. The stroke training apparatus of claim 22 further comprising a connecting member, wherein said connecting member is attached to said second side of said housing member and to a first side of said stabilization member.

24. A stroke training apparatus comprising:

a. a ball, wherein said ball has a total volume;

b. a housing member comprising a first side, wherein said first side comprises a planar area and an opening, wherein said opening is circumscribed by said planar area;

c. an attachment means for attaching said ball to said housing member, wherein said ball can rotate around an axis and a non-zero volume less than or equal to one-half of the total volume of said ball protrudes through said opening on said first side; and d. a stabilization member, wherein said stabilization member is capable of orienting said housing member at least one predetermined angle relative to a horizontal plane.

25. The stroke training apparatus of claim 24, wherein said housing member forms an angle of between 45 and 80 degrees with said horizontal plane.

26. A method for improving a racquet stroke, wherein said method comprises a. contacting a racquet with a stroke training apparatus, wherein said stroke training apparatus comprises i. a ball, wherein said ball has a total volume, ii. a housing member comprising a first side, wherein said first side comprises a lower planar area and an upper planar area, and an opening, wherein said opening is circumscribed by said planar area, and iii. an attachment means, wherein said ball is able to rotate about a horizontal axis, a non-zero volume less than or equal to one-half of the total volume of said ball protrudes through said opening on said first side, and said housing member forms an angle of between 45 and 80 degrees with a horizontal plane;

b. guiding said racquet along said lower planar area;

c. guiding said racquet along said a surface of said ball after guiding said racquet along said lower planar area; and d. guiding said racquet along said upper planar area after guiding said racquet along said surface of said ball.

27. The method according to claim 26 wherein said racquet is a tennis racquet.

28. The method according to claim 26, wherein said ball is a tennis ball.

* * * * *